United States Patent [19]

Crockett

[11] 4,164,084

[45] Aug. 14, 1979

[54] DISPLAY DEVICE

[76] Inventor: Charles Crockett, 1297 Logan Ave., Costa Mesa, Calif. 92626

[21] Appl. No.: 821,992

[22] Filed: Aug. 5, 1977

[51] Int. Cl.[2] ..... G09F 3/18

[52] U.S. Cl. ..... 40/19; 40/10 D; 40/607

[58] Field of Search ..... 40/19, 10 D, 145, 607; 220/82 R, 469

[56] References Cited

U.S. PATENT DOCUMENTS

| | | | |
|---|---|---|---|
| 719,597 | 2/1903 | Lee | 40/19 |
| 2,235,870 | 3/1941 | Dedmon | 40/19 |
| 2,625,762 | 1/1953 | McColl | 40/607 |
| 3,545,659 | 12/1970 | Libby | 220/82 R |

*Primary Examiner*—Louis G. Mancene

*Assistant Examiner*—Wenceslao J. Contreras

*Attorney, Agent, or Firm*—William F. McDonald

[57] ABSTRACT

A display device used to display bus schedules, bus routes, advertisement or other graphics is described which comprises an outer clear or transparent sleeve, a middle sleeve which graphics are attached or wrapped around, and an inner sleeve which is threaded on both ends. Attached to the inner sleeve via the threads are top and bottom end-plate caps. Both the top and bottom end-plate cap contain a groove so placed such that when the caps are screwed onto the inner sleeve the outer transparent sleeve fits into the groove on the top and bottom cap. The display device is attached to a support post or other structure via bolts and nuts passing through the inner sleeve and the post or other support structure.

8 Claims, 9 Drawing Figures

DISPLAY DEVICE

BACKGROUND OF THE INVENTION

The herein described invention is a display device. Said device is attached to a bus sign post or other post or support structure and displays a graphic sheet which informs of bus schedules, routes, advertisement or other information and also protects the graphics from weather or defacement. With the advent of transportation systems it became necessary to inform passengers utilizing these transportation systems of scheduling, routes etc. As for example, in a metropolitan city having an inter-city bus service it would be ideal to display at each bus stop both the schedule and route of the bus which services that stop. Each display device utilized to fulfill these ends would ideally have to be inexpensive in order to be installed at every stop. It would also have to be so designed as to allow the information on routing and scheduling to be readily changed.

The graphics themselves must be of a simple printed form, which can easily and economically be replaced. Further, since most bus systems grow or change as the cities grow or re-orient themselves to different transportation patterns, the bus stop signs and posts will, in all probability have been purchased and erected at different times and will not all be the same configuration and design. Thus any display device to be universally used on a variety of shapes and configurations of bus signs and posts must be adaptable to a large variety of configurations and shapes of different posts to which it is to be attached. Lastly, the display device should be weatherproof and, unfortunately, it should also offer some degree of protection against vandalism or against defacement of the graphics or abuse of the display device itself.

SUMMARY OF THE INVENTION

The present invention is a display device for displaying scheduling, routes, advertisement or other graphics and which is readily adaptable to almost every size or configuration of sign post or other structural support. Because of its simplicity of design it is both ecnomical to produce and easy to use. Additionally, since the graphic used in the instant transitube display device is both protected from the weather and from defacement, the graphic can be constructed of simple and inexpensive materials such as paper or cardboard sheets printed in conventional manner.

The transitube display device consists of three sleeves, an outer transparent sleeve, a middle sleeve, and an inner sleeve which is threaded at both ends. Two desirably identical end plate caps are screwed onto the top and bottom part of the inner sleeve. These caps each contain a groove into which the upper and lower edges of the outer sleeve fit respectively. This secures the outer sleeve to the inner sleeve, with the middle sleeve interspaced between the inner and outer sleeves. Fitted in the groove is an O-ring, which forms a weather tight seal between the outer sleeve and the cap. This seal, in conjunction with the tight seal formed between the inner sleeve and the caps by virtue of their threaded surface, forms an integral weather tight unit. The graphic is attached to the surface of the middle sleeve or rolled up in between the middle and outer sleeve and is displayed through the transparent outer sleeve. Thus placed, the graphic is protected from the weather but is still easily viewable from the exterior of the transitube display device. This display device is attached to a post or other support structure via a bolt or bolts passing through the walls of the inner sleeve, through the post or other support structure and back through the other wall of the inner sleeve and fastened with a nut. By virtue of its simplicity of attachment, the device can be installed to a variety of shapes and sizes of poles, struts, or other support structures. Since one usage of the device would be for indicating scheduling and routing of bus services, the display device as manufactured would have an inner sleeve with an internal diameter sufficient to fit most common sizes of support posts, struts, or other structural devices. This would allow the display device to be installed upon most common bus stop signs which are in normal usage. It is possible, however, to manufacture the display device in specific sizes.

In an embodiment the outer sleeve would be made of a transparent material such as acrylic or other high impact plastic. The middle sleeve would be a lightweight fiber or heavy duty cardboard cylinder. Both the end-plate caps and the inner sleeve would be made from an easily moldable and machineable but strong material. The O-rings and the bolts would be of standard construction. In other embodiments, any of the components could be be made from a material different from that described for the preferred embodiment.

Used in conjunction with the display device is a tool having a handle which is attached to a half ring or horseshoe shaped piece. At the ends of the half ring or horseshoe shaped piece are two prongs which project perpendicular to the plane of the half ring or horseshoe shaped piece. On the outer surface of both the top and bottom end plate caps are two cavities. These cavities are of the same shape as the prongs on the tool. The cavities may be simply round holes and the prongs round rods. However, in other embodiments the cavities and the prongs could be made of any shape, e.g. square, triangular, oval, etc. When in use, the tool fits around the projection of the inner sleeve through the hole in the end-plate cap and the prongs are inserted into the cavities on the outer surface of the end-plate cap. The tool provides leverage to tighten the end-plate caps to the inner sleeve to a degree beyond that possible by hand. This serves to deter any persons not having the tool from opening the display device once the end-plate caps are secured to the inner sleeve using the tool.

As noted, the display device will fit onto a variety of sizes and shapes of posts or other support structures. If desired when the display device is initially fastened to a post, washers or spacers may be inserted along the bolt fastening the inner cylinder to the post. These spacers or washers between the inner walls of the inner sleeve and the post or other support structure would prevent the transitube display device from jiggling or wobbling on the post. These spacers or washers can be of conventional design or they may be custom manufactured to fit flush against the surface of any odd shaped post or other support structure.

Other objects and features of the invention will become apparent from consideration of the following description taken in connection with the accompanying drawings.

DETAILED DESCRIPTION

Figure 2:
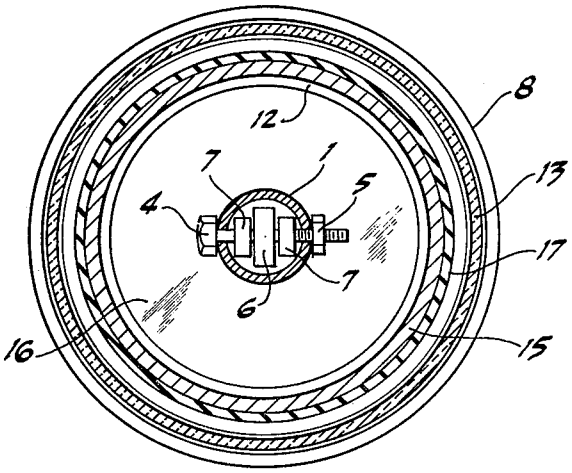
FIG. 2 is a sectional view at the line 2—2 of FIG. 1.
Figure 3:
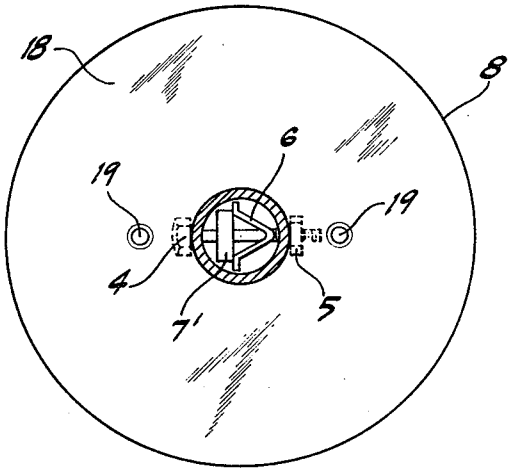
FIG. 3 is a view at the line 3—3 of FIG. 1, however, the configuration of the post is different from the configuration shown in FIGS. 1 and 2.
Figure 1:
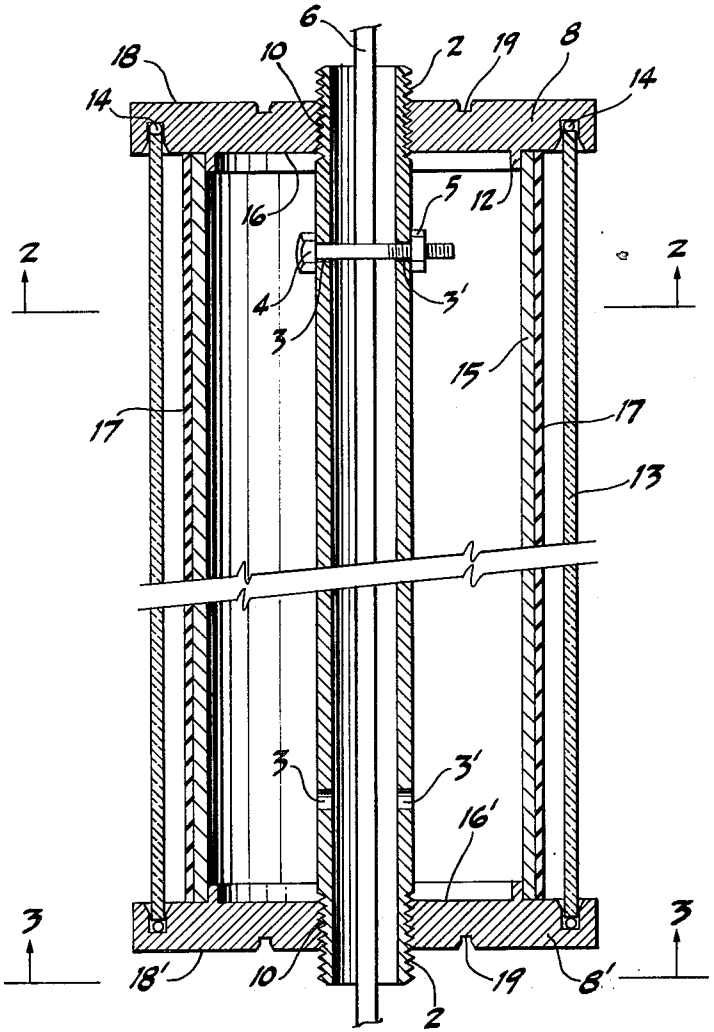
FIG. 1 is an elevational view of the display device.

In an embodiment of the display device shown in FIGS. 1, 2, 3, 4, and 7, inner sleeve 1 comprises a tube which is threaded at both ends with external screw threads 2. Passing through inner sleeve 1 are one or more sets of passage holes 3 and 3′ in opposite walls of the sleeve. A bolt 4 is passed through one wall of inner sleeve 1 through passage hole 3. The bolt is continued through a hole or other void in a post, pole, shaft or other support structure 6 and after passing back through the other wall of sleeve 1 via passage hole 3′ it is secured with a nut 5. FIGS. 1 and 2 show the support post as a flat shaft while FIG. 3 shows an attachment of the display device onto a compound angular support structure. Optionally, spacers or washers 7 can be inserted along the shaft of bolt 4 between the inner walls of sleeve 1 and the support post to restrict any lateral movement of bolt 4 through the support post.

Screwed onto both ends of inner sleeve 1 are top and bottom end-plate caps 8 and 8′ which may be identical. In the center of each cap 8 and 8′ is a hole or void 9 of the same diameter as the outside diameter of inner sleeve 1 and which is threaded with internal screw threads 10. Internal screw threads 10 match external screw threads 2 allowing caps 8 and 8′ to screw onto inner sleeve 1 and form a tight seal at the mating surface of 2 and 10. Extending circularly around cap 8 and 8′ are the inner surface 16 and 16′ and near the outside edge is a groove 11. The edge where groove 11 meets inner surface 16 and 16′ of cap 8 and 8′ may be beveled as in FIGS. 1 and 9 or optionally may form a right angle as in FIG. 5. Interspaced on the inner surface of the cap 8 and 8′ between the edge of hole 9 and groove 11 is a rib 12 extending circularly around the cap. The diameter of this circular rib 12 is slightly smaller than the diameter of the circular groove 11.

Outer sleeve 13 is a cylinder made of a transparent acrylic or other suitable material. The thickness of the wall of outer sleeve 13 is very slightly less than the width of groove 11 and the outside diameter of outer sleeve 13 is very slightly less than the inside diameter of groove 11 and the inside diameter of outer sleeve 13 is very slightly greater than the inside diameter of groove 11, which allows the top end of outer sleeve 13 to fit into the groove 11 of the top end-plate cap 8 and the bottom end of outer sleeve 13 to fit into the groove 11 of the bottom end plate cap 8′ as shown in FIG. 1.

Interspaced between the bottom of groove 11 in both the top and bottom end-plate caps 8 and 8′ and the top and bottom edges of outer sleeve 13 are O-rings 14 of the same diameter as the diameter of groove 11. O-rings 14 are of standard construction being formed of a resilient material which when compressed forms a seal between the groove 11 and the edge of outer sleeve 13. The length of outer sleeve 13 is such that when the top and bottom end-plate caps 8 and 8′ are screwed onto inner sleeve 1, outer sleeve 13 fits into the grooves 11 in the end-plate caps 8, 8′ and slightly compresses O-ring 14 forming a tight seal between outer sleeve 13 and end-plate caps 8, 8′. When the edge where groove 11 meets the inner surface of cap 8 is slightly bevelled it facilitates the initial introduction of outer sleeve 13 into groove 11.

Of a slightly smaller length and diameter than outer sleeve 13 is middle sleeve 15, which fits inside outer sleeve 13, In the embodiment shown in FIGS. 1 and 2 the inside diameter of middle sleeve 15 is slightly larger than the outside diameter of rib 12, such that when the top and bottom end-plate caps 8, 8′ are screwed onto inner sleeve 1 the circular ribs 12 on the top and bottom end-plate caps 8, 8′ fit into the top and bottom openings respectively of middle sleeve 15, positioning middle sleeve 15 within the display device. The length of middle sleeve 15 is such that when the end-plate caps 8, 8′ are screwed onto the inner sleeve 1 and come to rest with outer sleeve 13 in its position in grooves 11 in both the top and bottom end-plate 8, 8′; middle sleeve 15 rests flush against the inner surface 16′ of bottom end-plate cap 8′ but has a small space between the upper edge of middle sleeve 15 and the inner surface 16 of top end-plate cap 8.

The diameter of middle sleeve 15 and outer sleeve 13 are chosen such that a small void is formed between the surface of the outer wall of middle sleeve 15 and the inner wall of outer sleeve 13. In this void and wrapped around the middle sleeve 15 is placed a paper, cardboard, or similar sheet 17 printed with schedules, advertising, or other graphics which are being displayed in the display device. Graphic sheet 17 can be attached to middle sleeve 15 by tape, glue, etc., it may be wrapped around middle sleeve 15, or it may simply be inserted into the void and held in place between the outer wall of middle sleeve 15 and the inner wall of outer sleeve 13. In any case it is easily viewed through the transparent outer sleeve 13.

Figure 8:
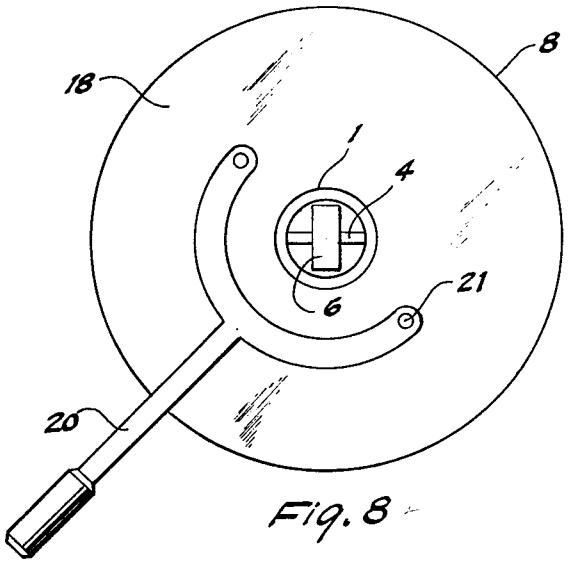
FIGS. 8 and 9 are a bottom view of the embodiment of FIG. 1 and an elevational view of an end-plate cap respectively and also showing a tool used to tighten the end-plate cap securely onto the inner sleeve of the display device.
Figure 9:
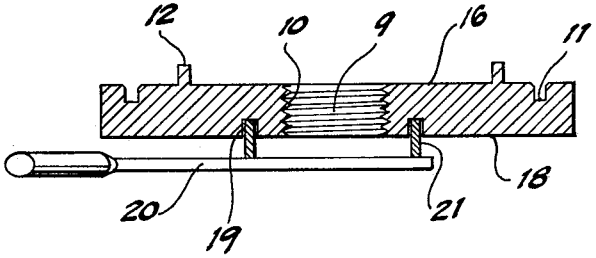

In the embodiment shown in FIGS. 1, 3 and 8, on the outer surface 18,18′ of cap 8, 8′ are two cavities, 19. These can simply be round holes as shown in the figures or they can be of other shapes. As shown in FIGS. 8 and 9 a tool having a handle portion and a half ring or horseshoe portion has two prongs 21 at the ends of the half ring or horseshoe. The prongs 21 project perpendicular to the horizontal plane of the tool 20, and are of the same shape as cavities 19. When in use the half ring or horseshoe portion of the tool fits around the end of inner sleeve which projects through cap 8 and also around the post or other support structure to which inner sleeve 1 is attached. The two prongs 21 are then pushed into cavities 19, the tool is then rotated to either loosen or tighten the end-plate caps 8, 8′ on the inner sleeve 1.

Figure 5:
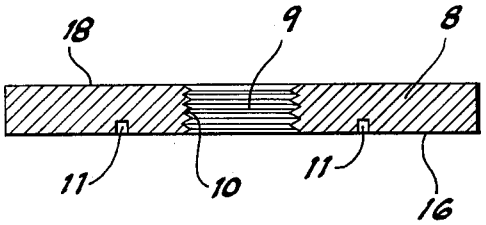
FIG. 5 is a vertical sectional view of an alternate embodiment of the end-plate cap of the display device.

In an alternate embodiment of cap 8, shown in FIG. 5, the cap 8 contains a hole 9 which has internal screw threads 10 and a groove 11 on its inner surface 16 extending circularly around the cap in the same manner as in the embodiment previously described. This embodiment differs from the previously described embodiment in that it does not have a rib 12 and cavities 19. In another embodiment cap 8 would be as depicted in FIG. 5 but would have a rib 12 on inner surface 16, but would not have cavities 19 in the outer surface 18. In yet another embodiment cap 8 would be as depicted in FIG. 5 but would have cavities 19 in the outer surface 18 but would not have a rib 12 on the inner surface 16. In any embodiment wherein cap 8 did not have cavities 19, cap 8 would simply be hand tightened onto inner sleeve 1. In any embodiment wherein cap 8 did not have rib 12, the middle sleeve 15 would be positioned by virtue of its co-cylindrical shape with outer sleeve 13.

Figure 6:
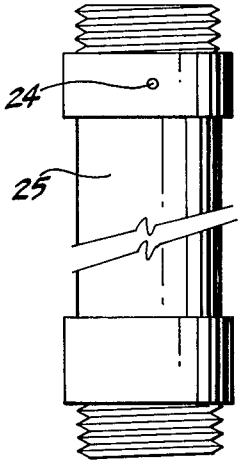
FIGS. 6 and 7 are a plan and a sectional view rotated 90°, respectively, of an alternate embodiment of the inner sleeve of the display device.
Figure 7:
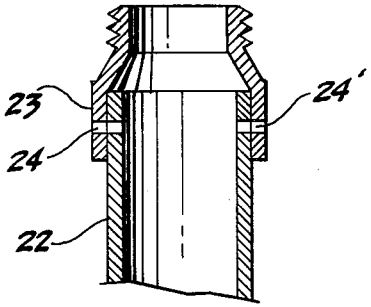
Figure 4:
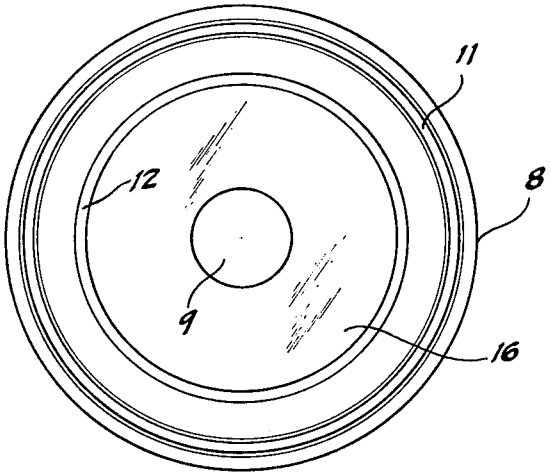
FIG. 4 is a view of the inner surface of an end-plate cap of the display device.

In an alterate embodiment of inner sleeve 25 shown in FIGS. 6 and 7 inner sleeve 25 will be formed from a tube 22 with a slip end thread connector 23 inserted over each end of the tube. The slip end thread connector 23 could be attached to tube 22 by friction, via very close tolerances, by glue, or any other conventional means. Alternatively, a passing hole 24, 24' would extend through both the threaded slip end connector 23 and tube 22. When the inner sleeve 25 is attached to a post or other structure via a bolt and nut as hereinbefore described the bolt would pass through passage hole 24 through the post or other structure and then pass through passage hole 24' and the nut attached. This would firmly attach both threaded slip end connector 23 to tube 22 and the total inner sleeve assembly 25 to the post or other support.

To use the display device, the device either as an assembled unit, or in pieces, is either slipped over the top of a post or other support structure or the post or other support structure is inserted through the top of the display device and the post then fastened to the ground. In any case, the top end plate cap is tightly screwed onto the inner sleeve. Optionally at this point threads of the inner sleeve 1 projecting above the upper surface of the top end-plate cap 8 can be crimped or otherwise distorted to prevent the top end-plate cap from being thereafter removed from sleeve 1. The inner sleeve is attached to the post or other support by passing a bolt through the passage hole in one wall of the inner sleeve through the post and back through the other wall of the inner sleeve and secured with a nut. Optionally, depending upon the shape of the post or other support structure, spacers or washers can be inserted along the shaft of the bolt between the inner walls of the inner sleeve and the post. The device could further be attached to the post with one or more additional bolts secured through other passage holes in the inner sleeve and post.

The middle sleeve is now lifted clear of the outer sleeve and a sheet of graphic is wrapped around or otherwise attached thereto. The outer sleeve is now slipped over the middle sleeve and the sheet of graphics. The bottom end cap is now lifted and screwed onto the lower end of the inner sleeve. As the bottom end plate cap progresses up the screw threads the ribs on the upper and lower end-plate caps fit inside of the middle sleeve and the top and bottom edges of the outer sleeve fit into the groove on the top and bottom end-plate caps.

The top and bottom edges of the outer cylinder mate against the O-rings in the top and bottom end-plate caps. The tool is placed against the bottom end-plate cap and the prongs inserted into the cavities. The tool is turned until the O-rings flatten between the bottom of the grooves and the edges of the outer sleeve which causes resistance. Further turning of the tool secures the bottom end-plate cap tightly to the rest of the assembly rendering it difficult to remove the end-plate caps without the tool.

The graphic inside is now clearly displayed and protected from weather, defacement, or theft, and further since the bolt and nut securing the display device is now fully enclosed within the chamber between the inner and middle sleeves, theft of the display device is suppressed.

To change the graphic, the bottom end-plate cap is loosened using the tool. It is further unscrewed and slid along with the outer and middle sleeves down the post. The middle sleeve is lifted out of the outer sleeve, the old graphic removed and a new one placed around the middle sleeve. The middle sleeve, outer sleeve, and bottom end-plate cap are then connected to the rest of the assembly as before.

Various modifications and changes may be made with regard to the foregoing description without departing from the spirit of the invention.

What is claimed is:

1. A display device which comprises:

A transparent outer sleeve, a middle sleeve, an inner sleeve fitted with external screw threads on both ends and having at least one passage hole extending perpendicularly through both walls of the inner sleeve, a top and bottom end-plate cap, each having a centralized hole of the same diameter as the inner sleeve, the walls defining such hole being fitted with internal screw threads and each cap having a groove extending circularly around the inner surface of the cap near the outer edge such that the middle sleeve fits around the inner sleeve and the outer sleeve fits around the middle sleeve and also fits into the groove on both the top and the bottom cap when the caps are screwed onto the threaded ends of the inner cylinder, intercolating and displaying a sheet of schedules, advertising, or other graphics inserted between the middle sleeve and the transparent outer sleeve.

2. The display device as claimed in claim 1 wherein both the top and bottom end-plate cap is provided with a rib extending circularly around the inner surface of the cap and positioned between the edge of the hole in the cap and the groove in the cap and having an outside radius the same as or slightly smaller than the inside radius of the middle sleeve such that the rib on the top and bottom caps fit into the ends of the middle sleeve when the caps are screwed onto the inner sleeve.

3. The display device as claimed in claim 1 wherein at least one of the top and bottom end-plate caps are provided with two cavities on the external surface of the cap.

4. The display device as claimed in claim 2 wherein the top and bottom end-plate caps are provided with two cavities on the external surface of the caps.

5. The display device as claimed in claim 1 wherein the grooves in the top and bottom end-plate caps are fitted with O-rings.

6. The display device as claimed in claim 1 wherein the inner sleeve is attached to a structural support by means of at least one bolt, each bolt passing through a separate hole in the inner sleeve and an opening in the structural support and secured with a nut.

7. The display device as claimed in claim 1 wherein the inner sleeve comprises a tube threaded with external screw threads on both ends of the tube.

8. The display device as claimed in claim 1 wherein the inner sleeve comprises a tube and a slip end threaded connector fitted over each end of the tube.

* * * * *